US006625933B1

(12) United States Patent
Moeller

(10) Patent No.: US 6,625,933 B1
(45) Date of Patent: Sep. 30, 2003

(54) ATTIC COVER

(76) Inventor: Chris R. Moeller, 4812 NW. Coves Dr., Kansas City, Platte County, MO (US) 64151-1139

( * ) Notice: Subject to any disclaimer, the term of this patent is extended or adjusted under 35 U.S.C. 154(b) by 19 days.

(21) Appl. No.: 10/162,045

(22) Filed: Jun. 3, 2002

(51) Int. Cl.[7] ..... E04F 19/08; E06B 3/26; E06B 7/16

(52) U.S. Cl. ..... 52/19; 52/202; 49/489.1

(58) Field of Search ..... 52/19, 202, 203; 49/504, 489.1; 182/46, 47, 77, 81

(56) References Cited

U.S. PATENT DOCUMENTS 3,931,699 A * 1/1976 Sarvay ..... 52/476
4,151,894 A * 5/1979 Edwards ..... 182/77
4,307,543 A * 12/1981 Schulthess ..... 49/501
4,337,602 A 7/1982 King
4,344,505 A * 8/1982 Waters et al. ..... 182/47
4,550,534 A * 11/1985 Mariano et al. ..... 52/19
4,658,555 A * 4/1987 Steiner ..... 52/202
4,928,441 A 5/1990 Daley
5,058,323 A * 10/1991 Gerritsen ..... 49/504
5,475,955 A * 12/1995 Dickinson ..... 52/202
5,481,833 A * 1/1996 Williams ..... 52/19
5,867,946 A 2/1999 Seagren
6,014,841 A * 1/2000 McCoy et al. ..... 52/19
RE36,975 E 12/2000 Williams
6,223,490 B1 5/2001 Wessley et al.
6,453,631 B1 * 9/2002 Headrick ..... 52/210

* cited by examiner

*Primary Examiner*—Carl D. Friedman
*Assistant Examiner*—Kevin McDermott

(57) ABSTRACT

An attic cover apparatus comprising a base, an insulating member, a panel, and a flange creating a decorative frame.

15 Claims, 2 Drawing Sheets

ATTIC COVER

The present invention pertains to a cover apparatus adapted to cover a room opening for the selective closing thereof, such as an attic opening.

BACKGROUND OF THE INVENTION

Most houses have one or more openings for access to the attic. Since attics are typically filled with dust particles and are a source of extreme temperature, attic opening covers have been developed to act as a dust and thermal barrier.

Attic opening covers of varying complexity are known in the art. Examples include those shown in King, U.S. Pat. No. 4,337,602, McCoy, Jr. et al., U.S. Pat. No. 6,014,841, Wessley et al., U.S. Pat. No. 6,223,490, and Williams, U.S. Pat. No. RE 36,975. Unfortunately, some prior art attic covers are relatively unsightly or unfinished in appearance. Moreover, they are often time-consuming and/or expensive to manufacture. Accordingly, to overcome these and other limitations of the prior art, an improved attic cover is desirable that is pleasing to the eye and yet relatively inexpensive to manufacture.

SUMMARY OF THE INVENTION

Accordingly, it is an object of the present invention to provide an attic cover that has a finished look and that is pleasing to the eye.

Another object of the present invention is to provide an attic cover that is easy and inexpensive to manufacture.

Yet another object of the present invention is to provide an attic cover that acts as a dust and thermal barrier and provides an energy benefit.

Additional objects, advantages and novel features of the invention will be set forth in part in the description which follows, and in part will become apparent in those skilled in the art upon examination of the following,

BRIEF DESCRIPTION OF THE DRAWINGS

In the accompanying drawings, which form a part of this specification, which are to be read in conjunction therewith and in which like reference numerals are used to indicate like parts in the various views.

DETAILED DESCRIPTION OF PREFERRED EMBODIMENT

Figure 1:
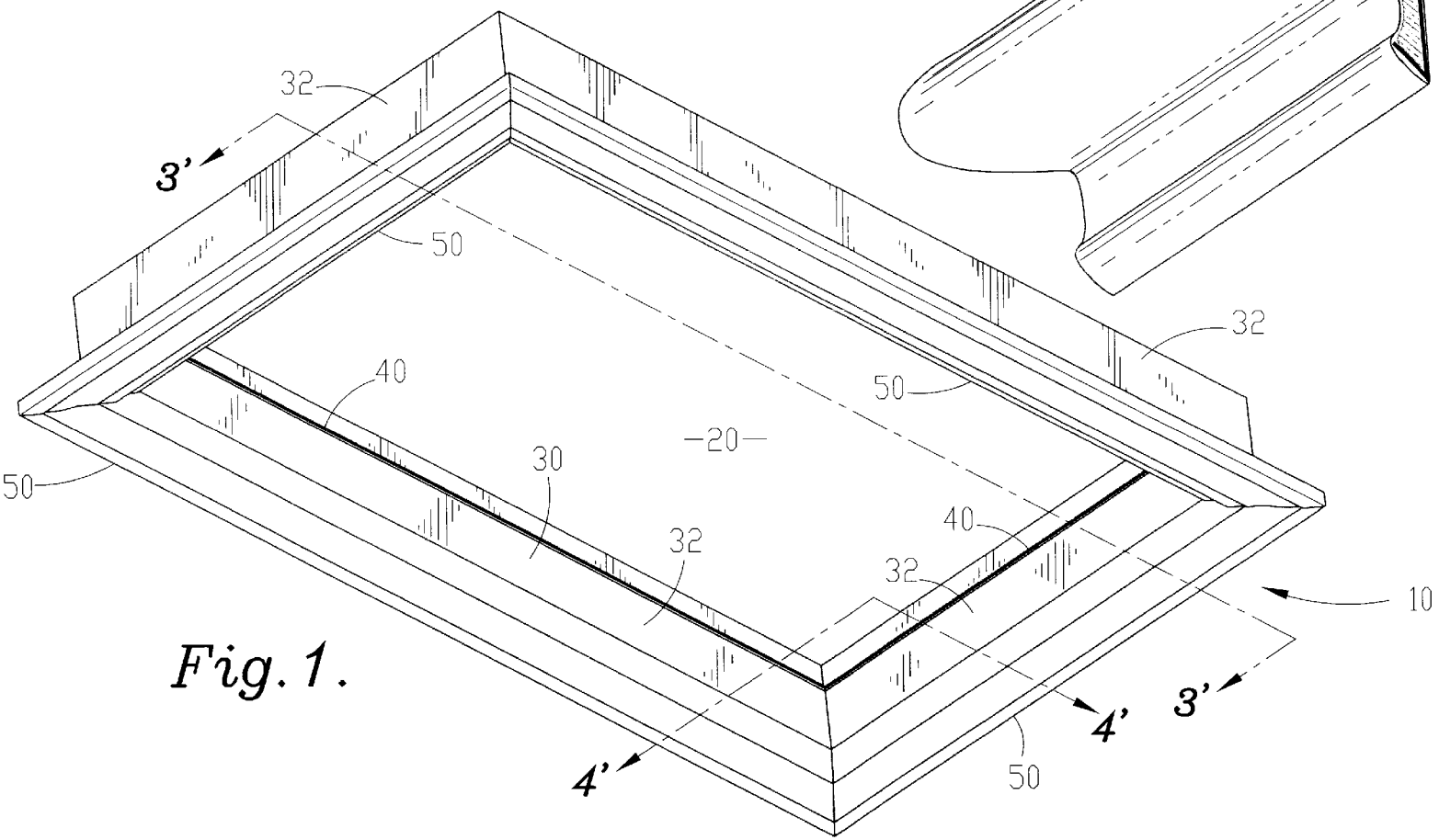
FIG. 1 is a perspective view of the attic cover apparatus of the present invention.

Turning now to the drawings, FIG. 1 illustrates the preferred cover apparatus (10) made in accordance with the present invention. The apparatus (10) includes a panel (20), a base (30) having a plurality of sidewalls (32), an insulating member (40), and a plurality of flanges (50).

The components of the apparatus (10) (with the exception of the insulating member) are preferably comprised of wood; however, it will be recognized to those skilled in the art that other materials, such as metals, plastics, and the like may be used to construct the cover apparatus (10). For example, the panel (20) could be comprised of glass, wood, or a combination of both to create a "window" to the attic. In addition, the panel (20) could have an insulating material on one or both sides thereof to provide an added thermal barrier effect.

The panel (20) and base (30) of the apparatus (10) preferably are rectangular in shape to fit the shape of most attic access openings. Those skilled in the art will understand that the device can be a number of different shapes, depending on the shape of the access opening. For example, if, for whatever reason, the attic opening is triangular in shape, the cover apparatus (10) would have three sidewalls (32) that correspond to the triangular shape and a panel (20) that is triangular in shape.

The base (30) has a top surface (33) extending around its periphery. In the preferred embodiment, as shown in FIG.1, the base (30) of the apparatus (10) has four side walls (32) with a J-shaped or backwards J-shaped cross-section as exemplified in FIGS. 3–6. As also shown in FIGS. 3–6, each top surface (33) of the sidewall (32) preferably contains a recess (34) for receiving the insulating member (40) and the panel (20). Further, each top surface (33) of the sidewall (32) preferably has a groove (36) for receiving a portion of the insulating member (40).

Figure 2:
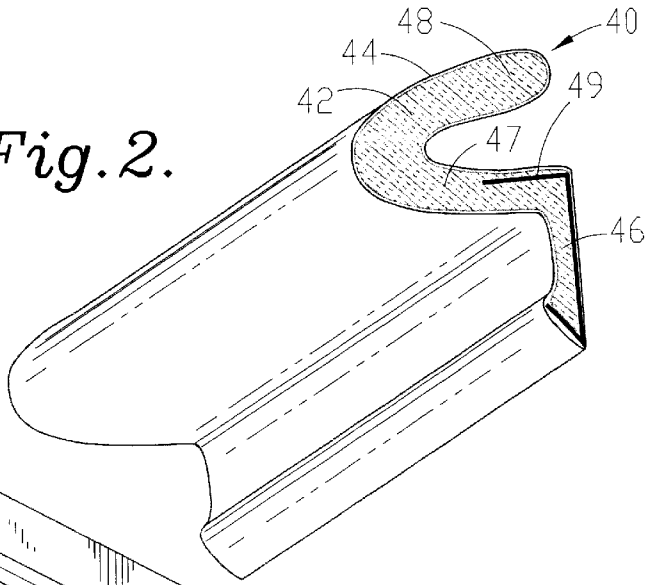
FIG. 2 is an enlarged perspective view showing a portion of the insulating member used in the attic cover apparatus of the present invention.
Figure 5:
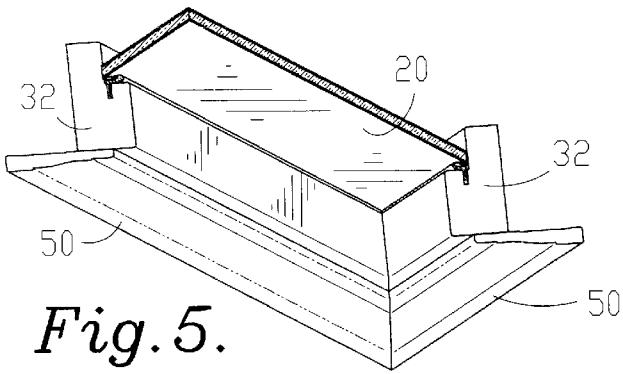
FIG. 5 is a perspective view of a cross-section of a corner of the attic cover apparatus of the present invention shown in FIG. 4 showing the panel in place.
Figure 6:
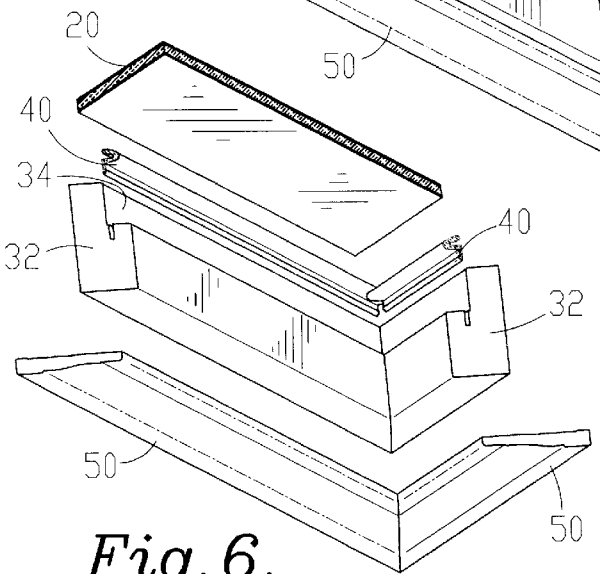
FIG. 6 is an expanded view of a cross-section of a corner of the attic cover apparatus of the present invention shown in FIG. 4 with the panel in place.

FIG. 2 shows a portion of the preferred insulating member (40) removed from the apparatus. The insulating member is preferably in the form of a gasket and is comprised of a padding or foam insulating material (42) surrounded by a flexible plastic layer (44). The insulating member preferably has a stem (46) and two legs (47, 48). The first leg (47) extends from the stem and engages the sidewalls (32). The second leg (48) extends from the first leg (47) and engages the panel (20). When undeformed (shown in FIG. 2), the first leg (47) and second leg (48) together form a "V"-shaped section of the insulating member (40). When compressed by the weight of the panel (20), the first leg (47) and second leg (48) are substantially parallel to the plane of the panel (FIG. 5). A rigid skeleton (49), such as a metal or plastic wire or strip, is also preferably placed in the insulating member (40) to facilitate the placement and retention of the stem (46) in the groove (36). Those skilled in the art will recognize that other shapes of insulating members could be used in the apparatus (10). For example, the insulating member (40) could be comprised of a stem (46) and a first leg (47) but no second leg (48). As another example, the insulating member (40) could also be a strip of foam insulating material or padding with no stem that resides between the panel (20) and the base (30).

Figure 3:
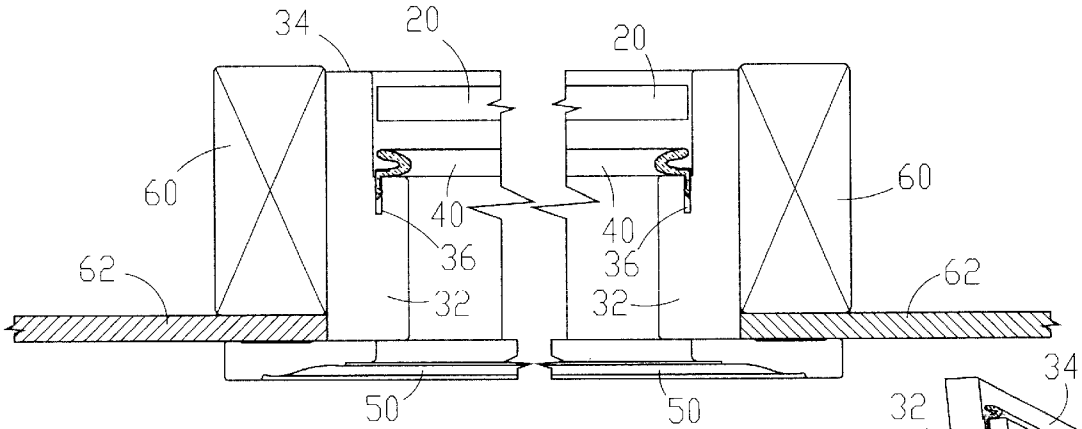
FIG. 3 is a cross-section of the attic cover apparatus of the present invention taken along line 3'—3' in FIG. 1 and shown in use in a wall.
Figure 4:
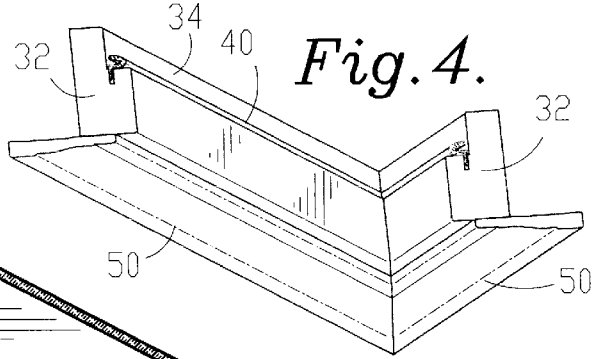
FIG. 4 is a perspective view of a cross-section of a corner of the attic cover apparatus of the present invention taken along line 4'—4' without the panel.

As exemplified in FIGS. 3 and 4, the insulating member (40) is securely attached to the sidewalls (32) by inserting the stem (46) into the groove (36). The insulating member (40) is preferably removable and can be replaced if the need arises. Those skilled in the art will recognize that the insulating member (40) could also be attached to the sidewalls (32) by glue, nails, tacks, screws, tape, or like devices. Moreover, while the insulating member (40) may be removable, permanent attachment of the insulating member may desirable, for example, when the insulating member (40) comprises a strip of foam or padding that merely resides between or rests on the panel (20) and the base (30).

FIG. 3 shows the cover apparatus (10) in use in an attic access opening. The sidewalls (32) of the apparatus (10) abut the joists (60) and drywall (62) of the attic ceiling. The sidewalls (32) are preferably mounted to the joists (60) using screws or nails (not shown). The panel may simply rest on the insulating member or be attached using hinges or other devices known to those skilled in one art so that access can be gained to the attic.

It is possible that there may be a small gaps (not shown) between the sidewalls and the drywall (62) because too much drywall (62) was inadvertently removed during construction of the access opening or the edge of the drywall (62) is not entirely straight. However, in use, such gaps will be covered by the flanges (50) of the cover apparatus (10). As shown in FIGS. 1 and 3–6, a flange (50) extends from each of the sidewalls (32) at about a 90-degree angle. Together the flanges (50) create a frame that covers the drywall (62) surrounding the attic access opening. To enhance the decorative aspects of the border, the flanges (50) may be comprised of baseboard, chair rail, ceiling, or similar types of trim with ornamental designs or lines. Screws, nails, or similar attachment devices known to those skilled in the art may also be used to draw the flanges (50) tight to the drywall (62) and close any space between the flanges (50) and the drywall (62).

To further enhance the anesthetic aspects of the apparatus (10), the panel (20) may also contain decorative elements. For example, the panel (20) may have ornamental lines, sculpted moldings, or paintings thereon. The panel (20) may also contain glass to create a window-like opening.

From the foregoing, it will be seen that this invention is one well-adapted to attain all the ends and objects herein above set forth together with the other advantages which are obvious which are inherent to the structure. It will be understood that certain features and subcombinations are of utility and may be employed without reference to other features and subcombinations. This is contemplated by, and is within the scope of, the claims. Since many possible embodiments may be made of the invention without departing from the scope thereof, it is understood that all matter herein set forth or shown in the accompanying drawings is to interpreted as illustrative, and not in a limiting sense.

What is claimed and desired to be secured by Letters Patent is as follows:

1. An attic cover for covering an attic access opening, said cover comprising:

a base having a plurality of sidewalls, said base forming a top surface;

an insulating member extending around at least a part of said top surface;

a panel overlying said insulating member;

wherein said insulating member includes a stem and said sidewalls have a groove for receiving said stem of said insulating member;

and wherein a rigid skeleton is placed in side said insulating member to facilitate placement and retention of said insulating member in said groove.

2. The attic cover of claim 1 wherein said base comprises four sidewalls.

3. The attic cover of claim 1 wherein said sidewalls have a recess for receiving said insulating layer and said panel.

4. The attic cover of claim 1 wherein said insulating member includes a first leg extending from said stem and wherein said stem engages said top surface of said sidewalls.

5. The attic cover of claim 4 wherein said insulating member further comprises a second leg extending from said first leg and wherein said second leg engages said panel.

6. The attic cover of claim 5 wherein said first leg and said second leg of said insulating member are compressed together under the weight of said panel.

7. The attic cover of claim 1 wherein said insulating member is comprised of foam insulating material.

8. The attic cover of claim 1 further comprising a flange extending from at least one sidewall.

9. The attic cover of claim 8 wherein said flange extends from at least one sidewall at about a 90-degree angle.

10. The attic cover of claim 1 further comprising a flange extending from each sidewall to create a frame surrounding the base of said cover.

11. An attic cover for covering an attic access opening, said cover comprising:

a base having a plurality of sidewalls, said base forming a top surface;

a removable panel overlying said base for access to said attic;

a plurality of decorative flanges extending from each of said side walls;

an insulating member extending around at least a part of said base;

wherein said insulating member includes a stem and said sidewalls have a groove for receiving said stem of said insulating member;

and wherein a rigid skeleton is placed in side said insulating member to facilitate placement and retention of said insulating member in said groove.

12. The attic cover of claim 11 wherein said sidewalls have a recess for receiving said insulating member and said panel.

13. The attic cover of claim 11 wherein said panel is attached to said base by one or more hinges.

14. An attic cover for covering an access opening, said cover comprising:

a base means extending around the periphery of said opening;

an insulating means extending around at least a part of said base means;

a panel means overlying said insulating means;

wherein said insulating means includes a stem and said sidewalls have a groove for receiving said stem of said insulating member;

and wherein a rigid skeleton is placed in side said insulating means to facilitate placement and retention of said insulating means in said groove.

15. The attic cover of claim 14 further comprising a flange means extending from each side wall to create a frame surrounding the base of said cover.

* * * * *